US009347016B2

(12) United States Patent
Fu et al.

(10) Patent No.: US 9,347,016 B2
(45) Date of Patent: May 24, 2016

(54) INDUSTRIAL GEAR LUBRICATING OIL COMPOSITION USED FOR RESISTING MICRO-PITTING

(75) Inventors: Xisheng Fu, Beijing (CN); Xiuling Hua, Beijing (CN); Jie Zhang, Beijing (CN)

(73) Assignee: PETROCHINA COMPANY LIMITED, Beijing (CN)

( * ) Notice: Subject to any disclaimer, the term of this patent is extended or adjusted under 35 U.S.C. 154(b) by 185 days.

(21) Appl. No.: 14/116,090

(22) PCT Filed: May 4, 2012

(86) PCT No.: PCT/CN2012/000600

§ 371 (c)(1),
(2), (4) Date: Feb. 18, 2014

(87) PCT Pub. No.: WO2012/152060

PCT Pub. Date: Nov. 15, 2012

(65) Prior Publication Data

US 2014/0162918 A1 Jun. 12, 2014

(30) Foreign Application Priority Data

May 6, 2011 (CN) ..... 2011 1 0116526

(51) Int. Cl.

| | |
|---|---|
| ***C10M 141/08*** | (2006.01) |
| ***C10M 141/10*** | (2006.01) |
| ***C10M 137/00*** | (2006.01) |
| ***C10M 137/08*** | (2006.01) |
| ***C10M 137/10*** | (2006.01) |
| ***C10M 169/04*** | (2006.01) |

(52) U.S. Cl.
CPC ..... *C10M 141/10* (2013.01); *C10M 169/04* (2013.01)

(58) Field of Classification Search
CPC . C10M 141/10; C10M 169/04; C10M 149/12
USPC ..... 508/421–442
See application file for complete search history.

(56) References Cited

U.S. PATENT DOCUMENTS 3,705,219 A * 12/1972 Nicholson ..... C07F 9/4028 508/423
4,431,552 A * 2/1984 Salentine ..... 508/159

(Continued)

FOREIGN PATENT DOCUMENTS

| | | | |
|---|---|---|---|
| CN | 1727459 A | * | 2/2006 |
| CN | 101517056 A | | 8/2009 |
| EP | 531000 A1 | * | 3/1993 |

*Primary Examiner* — Pamela H Weiss
(74) *Attorney, Agent, or Firm* — Mintz Levin Cohn Ferris Glovsky and Popeo, P.C.

(57) ABSTRACT

Provided is a micropitting corrosion resistant industrial gear lubricant composition, comprising: (A) at least a highly refined mineral oil, or synthetic oil or any combination of the above components; (B) at least a micropitting corrosion resistant additive; (C) at least an anti-wear additive; (D) at least a metal passivation additive; and (E) at least an anti-oxidation additive.

The lubricant composition has excellent high and low temperature performance and meets 68, 100, 150, 220, 320, 460 and 680 industrial gear oil viscosity level requirement. The lubricant composition has excellent micropitting corrosion resistance, anti-wear performance and anti-oxidation performance, passes FVA 54 micropitting corrosion resistant test, FAG FE-8 bearing wear test and SKF EMCOR bearing corrosion test, and is suitable for many large-scale industrial transmission gears and some automobile transmission gears, especially suitable for a gear transmission system for wind power generation.

11 Claims, 3 Drawing Sheets

(56) References Cited

U.S. PATENT DOCUMENTS

| | | | | |
|---|---|---|---|---|
| 2005/0113265 | A1* | 5/2005 | Yagishita | 508/188 |
| 2006/0025314 | A1* | 2/2006 | Henly | 508/273 |
| 2006/0276352 | A1* | 12/2006 | Vinci | 508/272 |
| 2009/0093384 | A1* | 4/2009 | Ward et al. | 508/205 |
| 2009/0275491 | A1* | 11/2009 | Komatsubara et al. | 508/192 |
| 2010/0009880 | A1* | 1/2010 | Okada | 508/438 |
| 2010/0048438 | A1 | 2/2010 | Carey et al. | |
| 2010/0105585 | A1* | 4/2010 | Carey et al. | 508/162 |

* cited by examiner

INDUSTRIAL GEAR LUBRICATING OIL COMPOSITION USED FOR RESISTING MICRO-PITTING

FIELD OF THE INVENTION

The present invention relates to a lubricant composition, and in particular, to a lubricant composition for a gear transmission system for wind power generation, within a technical field of lubricant.

RELATED ART

A pitting or micropitting corrosion, a typical damage by contact fatigue, is a failure form common in gears. The micropitting corrosion is a microscopic rolling contact fatigue and abrasion, which is frequently present on the face of the ground, surface-harden gear teeth of hard steel, and generally occurs at the conditions of rolling and sliding contact and thin film of oil.

In the past decade, the micropitting corrosion was paid attention on as a new fatigue wear on tooth face, which usually occurred in the mechanical parts under alternating load, such as cam, gear and rolling bearing. A number of large-scale industrial transmission gears and some transmission gears in automobile failed as a result of micropitting corrosion. The micropitting corrosion problems were of much interest in industrial application such as wind power generation. The micropitting corrosion would affect tooth accuracy, cause increased noises and vibration, resulting in reduction of gearing service life. According to incomplete statistics, the amount of the micropitting corrosion resistant industrial gear oil demanded is about 3000 tons per annum all over the country, and still is under growth.

The gear oil of new generation will be required to have broader service temperature, longer service life, more excellent extreme pressure abrasion resistance, and more better anti-friction and energy-saving properties, since the industrial gear oil has been considered as an important aspect in gear designing, with high speed development in the gear industry. For one thing, lubrication conditions in equipment were varied, with the industrial gear cases having tendency to more power, more load and less volume, and operating in moisture environment, wherein load enhancement caused tooth face contact pressure and abrasion between metal and metal and pitting to increase, smaller volume of gear cases caused the temperature of oil product to increase, and operation in moisture caused bearing corrosion to enhance. For another, the gear oil ensured lubrication of bearings while lubricating the gears. These variations challenged the industrial gear oil to abrasion resistance, loadability, micropitting corrosion resistance, thermostability and corrosion resistance. The standards reflecting these variations were represented by German standard DIN51517 and Flender standard of OEM (manufacturer of industrial gear cases), wherein the standards were added with the FVA 54 micropitting corrosion resistant test and FAG FE-8 bearing wear test.

Presently, demand of international gear OEM on the industrial gear oil was not based on the existing CKD heavy load industrial gear oil, but rather on the existing industrial gear oil relevant standards added with the micropitting corrosion resistant test. In more and more gear manufacturers, the micropitting corrosion resistant industrial gear oil was required to be used in the equipment developed by them; such oil products were produced only by one international company presently, but its formulation and composition were under strict confidentiality; by internal and international patent search, the patents in which the formulation and composition of the micropitting corrosion resistant industrial gear oil are the same as those of the present invention have not been found. The micropitting corrosion resistant industrial gear lubricant composition provided by the present invention, with superior performance, high technology and strong pertinence, enables lubrication in the gear transmission system for wind power generation, but also has better abrasion resistance, corrosion resistance, oxidation resistance and micropitting corrosion resistance than the international counterparts.

SUMMARY OF THE INVENTION

An object of the present invention is to provide a micropitting corrosion resistant industrial gear lubricant composition, having excellent high and low temperature performance, micropitting corrosion resistance, abrasion resistance, corrosion resistance and oxidation resistance, and enabling lubrication in the gear transmission system for wind power generation, wherein the composition is highlighted by excellent micropitting corrosion resistance.

For the purposes above, with carefully selection of the components as base oil and the components as additive in the lubricant composition, with overall study on the oils as the components, the function additive for each component, the interaction between the base oil and the additive, with micropitting corrosion resistance, abrasion resistance and oxidation resistance as study focus, the lubricant composition of the present invention is designed for lubrication in the gear transmission system for wind power generation.

The gear oil composition formulated by the present invention has excellent high and low temperature performance, micropitting corrosion resistance, abrasion resistance, corrosion resistance and oxidation resistance, meets the requirements of 68, 100, 150, 220, 320, 460, 680 industrial gear oil viscosity level, successfully passes FVA 54 micropitting corrosion resistant test, FAG FE-8 bearing wear test and SKF EMCOR bearing corrosion test, and enables lubrication in the gear transmission system for wind power generation. The product is low in production cost, superior in micropitting corrosion resistance, and is useful in the field of wind power generation to bring about good economic and social benefits. The lubricant composition is convenient in formulation, superior in performance and has attractive outlook of generalization.

The micropitting corrosion resistant industrial gear lubricant composition of the present invention comprises: (A) at least a highly refined mineral oil, or synthetic oil, or any combination of the above components; and (B) at least a micropitting corrosion resistant additive; (C) at least an anti-wear additive; (D) at least a metal passivation additive; and (E) at least an antioxidant additive. The (A) is the highly refined mineral oil, or synthetic oil, or any combination of the above components, and is contained in the lubricant composition at 88.00-98.79 wt %; the (B) is dialkyl dithiophosphate, or alkylphosphate amine salt, or m-diphosphonate, or mixture from any combination thereof, and is contained in the lubricant composition at 0.2-5.0 wt %; the (C) is trialkyl phosphate, or triaryl phosphate, or trialkyl thiophosphate, or triaryl thiophosphate, or mixture from any combination thereof, and is contained in the lubricant composition at 0.5-3.0 wt %; the (D) is the benzotriazole dialkylamine formaldehyde condensate, or thiadiazole alkylthiol hydrogen peroxide condensate, or mixture from any combination thereof, and is contained in the lubricant composition at 0.01-1.0 wt %; the (E) is 2,6-di-tert-butyl-4-methylphenol, or condensate of N-phenyl-α-naphthylamine and dialkyldiphenylamine, or dialkyl dithiocarbamate, or mixture from any combination thereof, and is contained in the lubricant composition at 0.5-3.0 wt %.

Further, the micropitting corrosion resistant industrial gear lubricant composition of the present invention comprises: (A) at least a highly refined mineral oil, or synthetic oil, or any combination of the above components; and (B) at least a micropitting corrosion resistant additive; (C) at least an anti-wear additive; (D) at least a metal passivation additive; and (E) at least an antioxidant additive.

Wherein the (A) is a highly solvent-refined mineral oil, or isomerized, dewaxed and hydrogenated, highly refined mineral oil, or poly(α-olefin) synthetic oil, or ester synthetic oil, or any combination of the above components, and is contained in the lubricant composition at an appropriate amount of 88.00-98.48 wt %;

the component (B) is preferably diisopropyl dithiophosphate, or isopropyl isooctyl dithiophosphate, or diisohexyl dithiophosphate, or diisooctyl dithiophosphate, or diisopropyl phosphate stearylamine salt, or isopropyl isooctyl phosphate stearylamine salt, or diisohexyl phosphate stearylamine salt, or diisooctyl phosphate stearylamine salt, or diisopropyl m-diphosphonate, or isopropyl isoctyl m-diphosphonate, or diisohexyl m-diphosphonate, or diisooctyl m-diphosphonate, or mixture from any combination thereof, and is contained in the lubricant composition at an appropriate amount of 0.3-5.0 wt %;

the component (C) is preferably tricresyl phosphate or triphenyl thiophosphate, or tributyl phosphate, or tributyl thiophosphate, or trioctyl phosphate, or trioctyl thiophosphate, or tri-dodecyl phosphate, or tri-dodecyl thiophosphate, or mixture from any combination thereof, and is contained in the lubricant composition at an appropriate amount of 0.6-3.0 wt %;

the component (D) is preferably benzotriazole di-n-butylamine formaldehyde condensate, or benzotriazole dioctylamine formaldehyde condensate, or thiadiazole dodecylthiol hydrogen peroxide condensate, or thiadiazole octadecylthiol hydrogen peroxide condensate, or mixture from any combination thereof, and is contained in the composition at an appropriate amount of 0.02-1.0 wt %; and the component (E) is preferably 2,6-di-tert-butyl-4-methyl phenol, or condensate of N-phenyl-α-naphthylamine and di-n-butyl diphenylamine, or condensate of N-phenyl-α-naphthylamine and butyl octyl diphenylamine, or condensate of N-phenyl-α-naphthylamine and butyl nonyl diphenylamine, or condensate of N-phenyl-α-naphthylamine and dioctyl diphenylamine, or condensate of N-phenyl-α-naphthylamine and dinonyl diphenylamine, or di-n-butyl dithiocarbamate, or di-n-octyl dithiocarbamate, or di-n-dodecyl dithiocarbamate, or mixture from any combination thereof, and is contained in the lubricant composition at an appropriate amount of 0.6-3.0 wt %.

Method for preparing the micropitting corrosion resistant industrial gear lubricant composition: to a stainless steel blending kettle equipped with a stirrer, adding the component oil (A) at a proportional amount; subsequently, adding the micropitting corrosion resistant additive (B), the anti-wear additive (C), the metal passivation additive (D) and the anti-oxidant additive (E) at a proportional amount, heating up to 50-60° C. with stirring for 4 hours, until the mixture is homogeneous and clear.

DETAILED DESCRIPTION OF THE INVENTION

Figure 1:
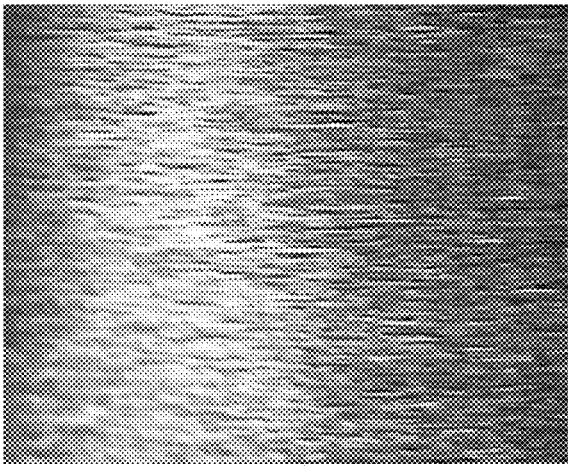
FIG. 1 is a photograph of a roller surface with a composition (IV) at oh.

The present invention will be further described for its effectiveness in the following examples. It shall be understood that, the following examples have no limitation to the scope of the present invention, and any modification without deviation from the conception and scope of the present invention will be within the scope of the present invention.

Example 1

The lubricant composition (I) was comprised of: 93.78 wt % of the highly solvent-refined mineral oil HVIS 500SN (properties shown in table 1) (Component A); 5.0 wt % of diisohexyl dithiophosphate (Component B); 0.60 wt % of tricresyl phosphate (Component C); 0.02 wt % of benzotriazole dioctylamine formaldehyde condensate (Component D); and 0.60 wt % of 2,6-di-tert-butyl-4-methyl phenol (component E). The Lubricant composition (II) was the same as the composition (I), except that the component (B), 5.0 wt % of diisohexyl dithiophosphate was replaced by 5.0 wt % of diisohexyl phosphate stearylamine salt. The lubricant composition (III) was the same as the composition (I), except that in the component (B), 5.0 wt % of diisohexyl dithiophosphate was replaced by 5.0 wt % of diisohexyl m-diphosphonate. The properties of the composition (I), (II) and (III) were set forth in table 2.

TABLE 1

HVIS 500SN main properties

| Item | HVIS 500SN Indicator | HVIS 500SN Observed value |
|---|---|---|
| Appearance | Clear yellow | Clear yellow |
| Kinematic viscosity, 100° C. $mm^2/s$ | Report | 10.98 |
| 40° C. $mm^2/s$ | 90~110 | 97.49 |
| Viscosity index | Not less than 95 | 96 |
| Flash point, ° C. | Not less than 235 | 271 |
| Chroma | Not more than 2.5 | <1.5 |
| Pour point, ° C. | Not more than −9 | −9 |
| Acid number, mgKOH/g | Not more than 0.03 | 0.02 |
| Carbon residue, % | Not more than 0.15 | 0.05 |
| Anti-emulsifying degree, min | | |
| 54° C. (40-37-3) | Not more than 30 | 11 (41-37-2) |
| Sulfur content | Report | <0.2 |
| Nitrogen content | Report | 171 |
| Hydrocarbon composition | | |
| Saturated hydrocarbon | | 76.5 |
| Aromatics | | 23.1 |
| Colloid | | 0.4 |

TABLE 2

Main properties and performance of the composition

| Item | Composition (I) | Composition (II) | Composition (III) |
|---|---|---|---|
| MPR simulation micropitting corrosion test Weight loss, mg | | | |
| 4 h | 0.20 | 0.08 | 0.15 |
| 5 h | 0.30 | 0.12 | 0.30 |

TABLE 2-continued

| Main properties and performance of the composition | | | |
|---|---|---|---|
| Item | Composition (I) | Composition (II) | Composition (III) |
| Width increment, mm | | | |
| 0 h | 1.00 | 0.80 | 1.05 |
| 4 h | 1.05 | 0.90 | 1.05 |
| 5 h | 1.05 | 0.95 | 1.05 |

It was seen from the table that, the pitting resistance of diisohexyl phosphate stearylamine salt as the micropitting corrosion resistant additive was preferred over that of diisohexyl dithiophosphate and diisohexyl m-diphosphonate.

Example 2

The lubricant composition (IV) was comprised of: 82.875 wt % of poly(α-olefin) synthetic oil PAO100 (its properties shown in table 3), 14.625 wt % of ester synthetic oil (its properties shown in table 4) (Component A); 0.5 wt % of diisooctyl m-diphosphonate, 0.1 wt % of diisooctylphosphate stearylamine salt, 0.4 wt % of isopropyl isooctyl dithiophosphate (Component B); 0.5 wt % of triphenyl thiophosphate (Component C); 0.05 wt % of thiadiazole dodecylthiol hydrogen peroxide condensate (Component D); 0.30 wt % of 2,6-di-tert-butyl-4-methyl phenol, 0.40 wt % of condensate of N-phenyl-α-naphthylamine and dinonyl diphenylamine, 0.25 wt % of di-n-butyl dithiocarbamate (Component E). The results of assessment of the lubricant composition (IV) were found in table 5.

TABLE 5

Figure 2:
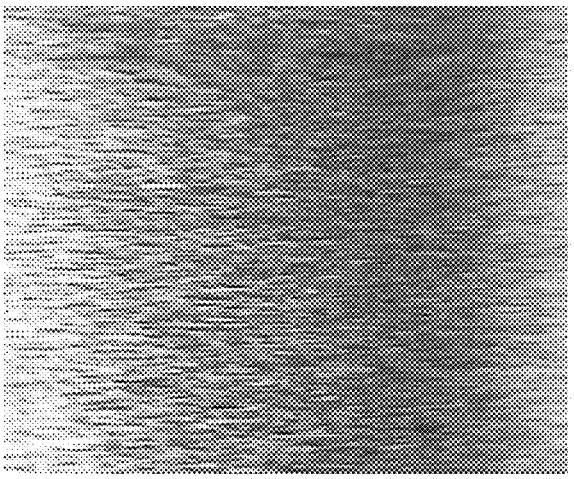
FIG. 2 is a photograph of a roller surface with control oil at 0 h.
Figure 3:
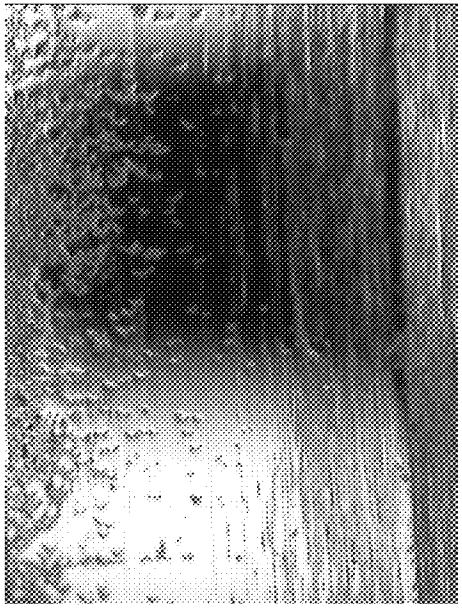
FIG. 3 is a photograph of a roller surface with a composition (IV) at 4 h.
Figure 4:
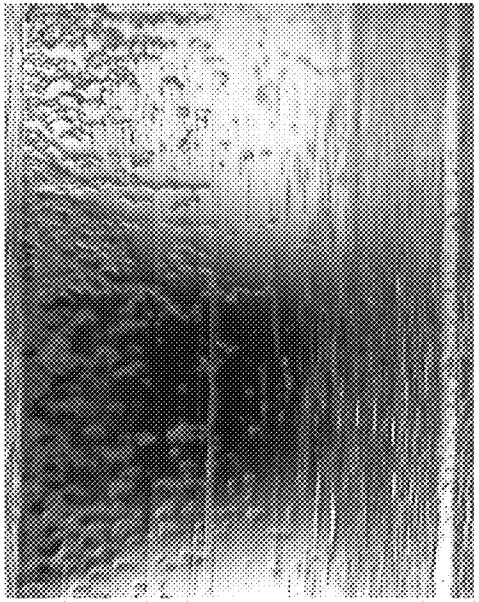
FIG. 4 is a photograph of a roller surface with control oil at 4 h.
Figure 5:
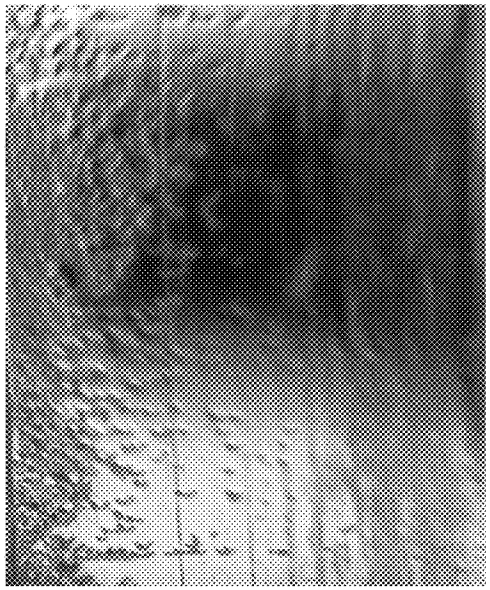
FIG. 5 is a photograph of a roller surface with a composition (IV) at 5 h.
Figure 6:
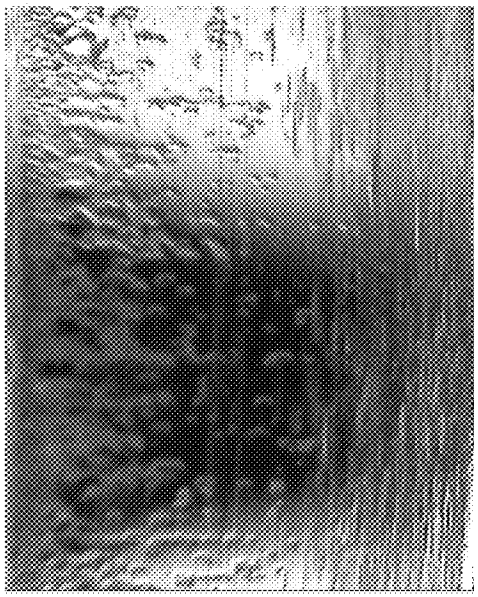
FIG. 6 is a photograph of a roller surface with control oil at 5 h.

| Results of assessment of the lubricant composition (IV) | | |
|---|---|---|
| Item | Composition (IV) | Control oil |
| MPR simulation micropitting corrosion test | | |
| Weight loss, mg | | |
| 4 h | 0.15 | 0.20 |
| 5 h | 0.20 | 0.30 |
| Width increment, mm | | |
| 0 h | 0.95 | 1.00 |
| 4 h | 1.00 | 1.05 |
| 5 h | 1.00 | 1.05 |
| Photomicrograph | See FIGS. 1, 3, 5 | See FIGS. 2, 4, 6 |

It was indicated from MPR simulation micropitting corrosion test results in table 5 and FIGS. 1, 2, 3, 4, 5 and 6 that, for weight loss, the composition (IV) on two rollers was slightly lower than, i.e. substantially was equivalent to the control oil, at 4 h and 5 h during testing; and for width variation of the roller, the composition (IV) post testing was slightly lower than the control oil. It was observed under microscope that, the composition (IV) was the same as the control oil on the surface of the roller at 0 h (FIG. 1, FIG. 2); from the photomicrographs (FIG. 3, FIG. 4) at 4 h after testing, the micropitting corrosion areas on the rollers were substantially equivalent, but the surface with the control oil had scratch. From the photomicrographs (FIG. 5, FIG. 6) at 5 h after testing, the micropitting corrosion area for the composition (IV) was substantially equivalent to that for the control oil.

From above, for micropitting corrosion resistance, the composition (IV) was similar as the control oil.

TABLE 3

| Main properties of PAO10, PAO100 | | | | |
|---|---|---|---|---|
| | PAO10 | | PAO100 | |
| Item | Indicator | Observed value | Indicator | Observed value |
| Appearance | Clear | Clear | Clear | Clear |
| Kinematic viscosity, 100° C. $mm^2/s$ | 9~11 | 10.52 | 97~115 | 100.1 |
| 40° C. $mm^2/s$ | Report | 70.84 | 1200~1540 | 1241 |
| Viscosity index | Not less than 120 | 135 | Not less than 120 | 167 |
| Pour point, ° C. | Not more than −45 | <−45 | Not more than −21 | −27 |
| Flash point (open), ° C. | Not less than 200 | 245 | Not less than 270 | 284 |
| Mechanical impurities, % | Not more than 0.01 | 0.001 | Not more than 0.05 | 0.005 |
| Moisture, % | Not more than trace | Trace | Not more than trace | Trace |

TABLE 4

| Main properties of ester oil | | | |
|---|---|---|---|
| Item | Indicator | Observed value | Testing method |
| Appearance | Clear | Clear | Visual check |
| Kinematic viscosity, $mm^2/s$ 40° C. | Report | 19.68 | GB/T265 |
| 100° C. | 4~5 | 4.42 | |
| Viscosity index | Not less than 120 | 140 | GB/T1995 |
| Pour point, ° C. | Not more than −45 | −51 | GB/T3535 |
| Flash point (open), ° C. | Not less than 200 | 250 | GB/T3536 |
| Acid number, mgKOH/g | Not more than 0.1 | 0.05 | GB/T4945 |

Example 3

The lubricant composition (V) was comprised of: 97.5 wt % of poly(α-olefin) synthetic oil PAO10 (its properties shown in table 3) (its properties shown in table 4) (Component A); 0.5 wt % of diisooctyl m-diphosphonate, 0.1 wt % of diisooctylphosphate stearylamine salt, 0.4 wt % of isopropyl isooctyl dithiophosphate (Component B); 0.5 wt % of triphenyl thiophosphate (Component C); 0.05 wt % of thiadiazole dodecylthiol hydrogen peroxide condensate (Component D); 0.30 wt % of 2,6-di-tert-butyl-4-methyl phenol, 0.40 wt % of condensate of N-phenyl-α-naphthylamine and dinonyl diphenylamine, 0.25 wt % of di-n-butyl dithiocarbamate (Component E).

INDUSTRIAL APPLICABILITY

The MPR micropitting corrosion simulation test was used in the laboratory for simulation and assessment on the present invention. The MPR micropitting corrosion simulation tester was specially used to generate micropitting or pitting corrosion at the specific conditions of simulation test, especially for contact simulation of the moving parts such as gear and rolling bearing. The tester allowed 1 million fatigue contacts per hour in consideration of design, thus making the testing time be significantly shortened, and allowing investigation of effects of the additive composition on pitting and micropitting corrosion. The test for simulation of micropitting corrosion was divided into 4 stages, with load progressively increased from Stage 1 to Stage 4, each running for 1 h; after 4 h, abrasion of the roller for testing was evaluated, and then Stage 4 (1 h) was repeated, prior to evaluation of abrasion of the roller. The final assessment was performed in terms of: (1) weight loss: the rollers for testing were weighed at 0 h, 4 h, and 5*h*, and observed for weight loss; (2) width variation of the roller: the width variations of the roller were observed at 0 h, 4 h and 5 h, due to width increase caused by abrasion from micropitting corrosion, with width of new testing roller being 1 mm; (3) photomicrograph: the abrasion from micropitting corrosion on the surface of the rollers was observed under microscope at 0 h, 4 h and 5 h.

For assessment of the lubricant composition, the FZG gear bench for micropitting corrosion test, the FAG FE-8 bench for bearing wear test, SKF EMCOR bench for bearing corrosion test were used. The FVA micropitting corrosion test bench was developed by the FZG Gear Research Center, Munich Technology University, Germany, primarily for assessment of service performance of lubricant and materials. The micropitting corrosion testing method was also developed by the FZG Gear Research Center, now belonging to the standards of the Power Transmission Committee, German Machinery Manufacturer Association (FVA), with the method No. FVA 54/I-IV. The FE-8 bearing wear test bench was developed by the FAG bearing Corp. Germany, primarily for assessment of effects of lubricant, grease and additives thereof on abrasion, and also for investigation of abrasion of bearing materials. This testing method now belongs to German national standards, with the method No. DIN 51819. The SKF EMCOR test bench was developed by SKF Corp., Sweden, and used for assessment of tarnishing resistance of lubricant greases and oils; depending on application environment of the lubricant greases, the test solution was available from the distilled water or de-ionized water, synthetic sea water and synthetic brine; the test was cyclically run without load at room temperature and at low speed of revolution for total testing time of 164 h, for measurement of corrosion resistance of rolling bearings.

The results of assessment of the lubricant composition (V) from Example 3 were found in table 6.

TABLE 6

Results of assessment of the lubricant composition (V)

| Testing item | Testing results | Following |
|---|---|---|
| kinematic viscosity (40□), $mm^2/s$ | 63.39 | GB/T 265-1988 |
| kinematic viscosity (100□), $mm^2/s$ | 9.619 | |
| Viscosity index | 134 | GB/T 1995-1998 |
| Pour point, ° C. | −39 | GB/T 3535-2006 |
| Flash point (open), ° C. | 267 | GB/T 3536-2008 |
| Moisture, % (m/m) | Trace | GB/T 260-1977(1988) |
| Mechanical impurities, % (m/m) | 0.003 | GB/T 511-1988 |
| Copper corrosion (100□ × 3 h), level | 1b | GB/T 5096-1985(1991) |
| Resistance to emulsion (82° C.), water in oil, % | 0.8 | GB/T 8022-1987 |
| Emulsion layer, mL | Trace | |
| Total moisture, mL | 82.8 | |
| Rust test in liquid phase: synthetic sea water | Rustless | GB/T 11143-2008 |
| Froth (froth tendency/froth stability), mL/mL | | GB/T 12579-2002 |
| 24° C. | 0/0 | |
| 93.5° C. | 15/0 | |
| 24° C., later | 0/0 | |
| Resistance to emulsion(40-37-3) (54□), min | 15 | GB/T 7305-2003 |
| FZG gear test (A/8.3/90), passing level | >12 | SH/T 0306-1992 |
| SKF EMCOR bearing corrosion test | 0/0 | |
| Synthetic sea water, tarnishing level | | |
| FE-8 bearing wear test | | |
| Abrasion loss of rolling body, mg | 1 | DIN 51819-3 |
| Abrasion loss of retainer, mg | 32 | |
| FVA54 micropitting corrosion test | | |
| Failure load to micropitting corrosion, level | >10 | FZG FVA54/I-IV |
| Loadability for micropitting corrosion | High | |

It was indicated from the test results in table 6 that, the product of the present invention was well qualified for the FVA 54 micropitting corrosion resistant test, the FAG FE-8 bearing wear test and the SKF EMCOR bearing corrosion test, and enabled lubrication in the gear transmission system for wind power generation.

What is claimed is:

1. A micropitting corrosion resistant industrial gear lubricant composition, comprising:

(A) a highly refined mineral oil, or synthetic oil, and combinations thereof in an amount of 88.00-98.79 wt. % based on the composition;

(B) a micropitting corrosion resistant additive in an amount of 0.2-5.0 wt. % based on the composition-comprising a m-diphosphonate selected from the group consisting of diisopropyl m-diphosphonate, isopropyl isoctyl m-diphosphonate, diisohexyl m-diphosphonate, and diisooctyl m-diphosphonate;

(C) an anti-wear additive in an amount of 0.5-3.0 wt. % based on the composition selected from the group consisting of trialkyl phosphate, triaryl phosphate, trialkyl thiophosphate, triaryl thiophosphate, and mixtures thereof;

(D) a metal passivation additive in an amount of 0.01-1.0 wt. % based on the composition selected from the group consisting of benzotriazole dialkylamine formaldehyde condensate, thiadiazole alkylthiol hydrogen peroxide condensate, and mixtures thereof;

(E) an antioxidant additive in an amount of 0.5-3.0 wt. % based on the composition selected from the group consisting of 2,6-di-tert-butyl-4-methylphenol, a condensate of N-phenyl-α-naphthylamine, dialkyldiphenylamine, dialkyl dithiocarbamate, and mixtures thereof.

2. The micropitting corrosion resistant industrial gear lubricant composition according to claim 1, wherein the component (A) is selected from the group consisting of a highly solvent-refined mineral oil, isomerized, dewaxed and hydrogenated highly refined mineral oil, poly(α-olefin) synthetic oil, ester synthetic oil, and combinations thereof in an amount of 88.00-98.48 wt. % based on the composition.

3. The micropitting corrosion resistant industrial gear lubricant composition according to claim 1, further comprising dialkyl dithiophosphate and a dialkylphosphate amine salt.

4. The micropitting corrosion resistant industrial gear lubricant composition according to claim 1, wherein the component (C) is selected from the group consisting of tricresyl phosphate or triphenyl thiophosphate, tributyl phosphate, tributyl thiophosphate, trioctyl phosphate, trioctyl thiophosphate, tri-dodecyl phosphate, tri-dodecyl thiophosphate, and mixtures thereof, and is in an amount of 0.6-3.0 wt. % based on the composition.

5. The micropitting corrosion resistant gear lubricant composition according to claim 1, wherein the component (D) is selected from the group consisting of benzotriazole di-n-butylamine formaldehyde condensate, benzotriazole dioctylamine formaldehyde condensate, thiadiazole dodecylthiol hydrogen peroxide condensate, thiadiazole octadecylthiol hydrogen peroxide condensate, and mixtures thereof, and is in an amount of 0.02-1.0 wt. % based on the composition.

6. The micropitting corrosion resistant gear lubricant composition according to claim 1, wherein the component (E) is selected from the group consisting of 2,6-di-tert-butyl-4-methyl phenol, condensate of N-phenyl-α-naphthylamine and di-n-butyl diphenylamine, condensate of N-phenyl-α-naphthylamine and butyl octyl diphenylamine, condensate of N-phenyl-α-naphthylamine and butyl nonyl diphenylamine, condensate of N-phenyl-α-naphthylamine and dioctyl diphenylamine, condensate of N-phenyl-α-naphthylamine and dinonyl diphenylamine, di-n-butyl dithiocarbamate, or di-n-octyl dithiocarbamate, di-n-dodecyl dithiocarbamate, and mixtures thereof, and is in an amount of 0.6-3.0 wt. % based on the composition.

7. The micropitting corrosion resistant industrial gear lubricant composition according to claim 1, further comprising dialkyl dithiophosphate.

8. The micropitting corrosion resistant industrial gear lubricant composition according to claim 7, wherein the dialkyl dithiophsphate is selected from the group consisting of diisopropyl dithiophosphate, isopropyl isooctyl dithiophosphate, diisohexyl dithiophosphate, diisooctyl dithiophosphate, and mixtures thereof; and wherein the component (B) is contained in an amount of 0.3-5.0 wt. % based on the composition.

9. The micropitting corrosion resistant industrial gear lubricant composition according to claim 1, further comprising a dialkylphosphate amine salt.

10. The micropitting corrosion resistant industrial gear lubricant composition according to claim 9, wherein the dialkylphosphate amine salt is selected from the group consisting of diisopropyl phosphate stearylamine salt, isopropyl isooctyl phosphate stearylamine salt, diisohexyl phosphate stearylamine salt, diisooctyl phosphate stearylamine salt, and mixtures thereof; and wherein the component (B) is contained in an amount of 0.3-5.0 wt. % based on the composition.

11. The micropitting corrosion resistant industrial gear lubricant composition according to claim 3, wherein:

the dialkyl dithiophsphate is selected from the group consisting of diisopropyl dithiophosphate, isopropyl isooctyl dithiophosphate, diisohexyl dithiophosphate, diisooctyl dithiophosphate, and mixtures thereof;

the dialkylphosphate amine salt is selected from the group consisting of diisopropyl phosphate stearylamine salt, isopropyl isooctyl phosphate stearylamine salt, diisohexyl phosphate stearylamine salt, diisooctyl phosphate stearylamine salt, and mixtures thereof;

and the component (B) is contained in an amount of 0.3-5.0 wt. % based on the composition.

* * * * *